United States Patent [19]

Brandon

[11] 4,093,028

[45] June 6, 1978

[54] METHODS OF USE OF CEMENTITIOUS MATERIALS AND SONIC OR ENERGY-CARRYING WAVES WITHIN SUBSURFACE FORMATIONS

[75] Inventor: Clarence W. Brandon, Nashville, Tenn.

[73] Assignee: Orpha B. Brandon, Nashville, Tenn.; a part interest

[21] Appl. No.: 721,605

[22] Filed: Sep. 7, 1976

Related U.S. Application Data

[63] Continuation-in-part of Ser. No. 406,045, Oct. 12, 1973, Pat. No. 3,981,624, which is a continuation-in-part of Ser. No. 611,082, Jan. 23, 1967, Pat. No. 3,765,804, which is a continuation-in-part of Ser. No. 665,995, Jun. 17, 1957, Pat. No. 3,302,720.

[51] Int. Cl.[2] ..... E21B 33/138; E21B 33/14

[52] U.S. Cl. ..... 166/281; 166/286; 166/291

[58] Field of Search ..... 166/249, 177, 286, 292, 166/291, 281, 308

[56] References Cited

U.S. PATENT DOCUMENTS

| | | | |
|---|---|---|---|
| 2,072,982 | 3/1937 | Dale | 166/286 |
| 2,213,486 | 9/1940 | Dale | 166/286 X |
| 2,918,126 | 12/1959 | Bodine | 166/249 |
| 2,974,273 | 3/1961 | Vogel et al. | 166/177 X |
| 3,016,093 | 1/1962 | Bodine | 166/249 |
| 3,239,005 | 3/1966 | Bodine, Jr. | 166/286 |
| 3,799,874 | 3/1974 | Parker | 166/291 X |

OTHER PUBLICATIONS

Vren, L. C., "Petroleum Production Engineering, Oil Field Development", 3rd Edition, McGraw-Hill Book Co., Inc., N.Y., 1946, pp. 485–487, 517–521, 524, 525.

*Primary Examiner*—Stephen J. Novosad

[57] ABSTRACT

Methods of use of cementitious material within sub-surface formations are considerably enhanced by the use of sonic or energy carrying waves therewith; and by the further use of fluids containing a gas, foam, emulsion or solvent in combination therewith a cleansing and better penetration into the formation is achieved; thus effecting further benefits of the use of sonic or energy carrying waves with cementitious materials.

51 Claims, 7 Drawing Figures

1150
1152
1154
1156
1158
1160
1162
1164
1166
1168
1170
1172

1196
1206
1208
1212
1210
1154
1150
1054

1196
1154
1198
1150

1204
1154
1150
1196
1054.
1206
1194
1192

1204
1196
1200
1198
1192
1194
1202
1054
1150
1154

METHODS OF USE OF CEMENTITIOUS MATERIALS AND SONIC OR ENERGY-CARRYING WAVES WITHIN SUBSURFACE FORMATIONS

CROSS-REFERENCES TO RELATED APPLICATIONS

This invention relates to methods of use of cementitious materials and sonic or energy carrying waves within subsurface formations or strata and has previously been disclosed and claimed in earlier related applications and the disclosure of which is expanded and further claiming added in the subject application which is a continuation-in-part of my co-pending application Ser. No. 406,045 filed Oct. 12, 1973, U.S. Pat. No. 3,981,624; which is a continuation-in-part of application Ser. No. 611,082 filed Jan. 23, 1967, U.S. Pat. No. 3,765,804; which is a continuation-in-part of my prior application Ser. No. 665,995 filed June 17, 1957, U.S. Pat. No. 3,302,720.

The art prior to applicant's above originally filed application that is known to applicant is typified by the Dale U.S. Pat. No. 2,072,982, Kennedy et al. U.S. Pat. No. 2,104,488, Bankston U.S. Pat. No. 2,546,252 and subsequent Brown U.S. Pat. No. 2,743,779.

SUMMARY AND OBJECTS OF THE INVENTION

The primary object of this invention is to facilitate the introduction of cementitious materials into subsurface formations by the use of sonic or energy-carrying waves.

A very important object of this invention is in the use of fluids containing gases, foams, emulsions or solvents ahead of or in the leading edge of the cementitious material being introduced as of the above object as a means of cleansing foreign materials from the formation for a better bonding thereto of the cementitious material and a further penetration of the cementitious material thereinto of the interstices and pore spaces of the formation.

An important specific object in relation to the first above object is to use sonic or energy-carrying waves having characteristics that will allow the introduction of cementitious material of a much drier mixture and at a considerably lower introduction pressure into the subsurface formation and yet effect a greater degree of bonding and penetration of the cementitious material into the formation.

An extremely important object is to use the methods of the above objects to effect a greater efficiency of cementing casing or liners into well bores; squeeze cementing of ruptures or holes in well caasing or liners, of channels existing behind casings or liners in well bores, of undesired fluids coming to the well bore, of permeable formations allowing entry into or out of well bores of fluids from other formations or strata and the sealing off of portions of strata so as to allow fracturing of other portions of the strata or of portions of strata having a greater variability of permeability in relation to other portions of the strata in regard to the entry into or out thereof of various types of fluids.

These together with other objects and advantages which will become subsequently apparent reside in the details of construction and operation as more fully hereinafter described and claimed, reference being had to the accompanying drawings forming a part hereof and to FIGS. 1–4 of my U.S. Pat. No. 3,640,344 which is incorporated into this application by reference, wherein like numerals refer to like parts throughout, and in which as to this application:

Figures 1, 2, 3:
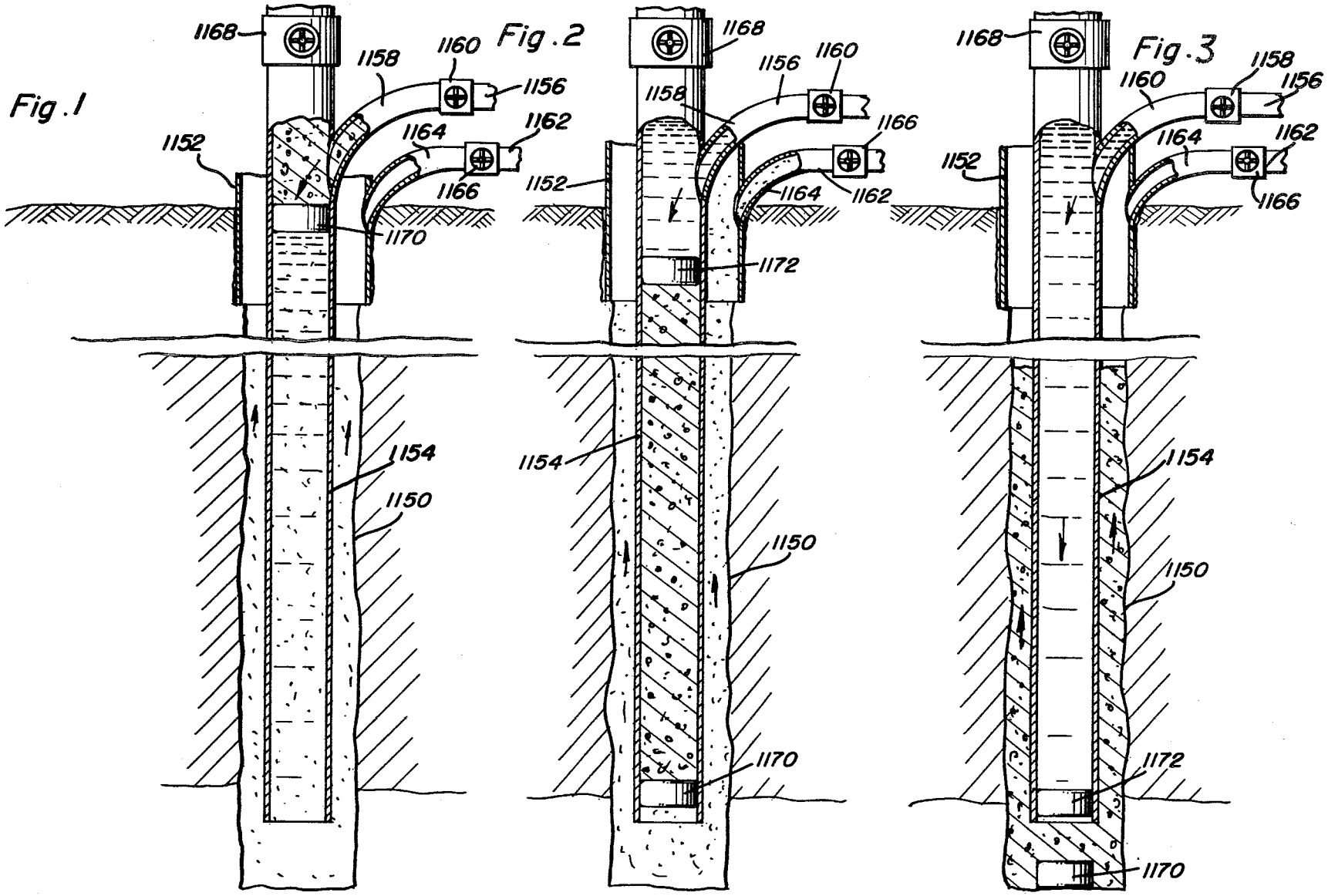
FIGS. 1–3 are sequential diagrammatic views illustrating in vertical section, with parts broken away, a conventional cementing method for well casings or liners to which the principles of this invention are applied.

FIG. 1 of my U.S. Pat. No. 3,640,344 incorporated into this application by reference is a vertical sectional view, somewhat diagrammatic and with parts broken away, is one form of apparatus, which is adapted for producing various types of sonic or energy-carrying waves and imposing thereon the various types of modulations which are described and claimed and to which the principles of this invention are applied and used;

FIGS. 8–14 U.S. Pat. No. 3,640,344 are diagrammatic views illustrating graphically methods of the hydraulic pressing and release of fluids from well bores and formations or strata and of various methods of compounding sonic or energy-carrying waves and modulations thereto to obtain optimum results of cementing within well bores casing or liners and formations or strata by resultant varying frequencies and modulations thereto as between well bores and casings or liners or well bores and formations or strata.

SONIC OR ENERGY-CARRYING WAVE CEMENTING OF CASING, TUBING OR LINERS INTO WELL BORES WITHIN FORMATIONS

Disclosed in my parent application Ser. No. 665,995 filed June 17, 1957, now U.S. Pat. No. 3,302,720 in FIGS. 64–66 and 71–74 therein are methods or processes whereby the efficiency of conventional cementing operations with respect to securing conductors within well bores into subsurface strata or formations and of various cement squeezing methods or processes are greatly facilitated and enhanced by the use of sonic or energy-carrying waves and modulations thereto.

These same disclosures and FIGURES were continued in their entirety into application Ser. No. 611,082 filed Jan. 23, 1967, now U.S. Pat. No. 3,765,804, while certain original basic claims of these cementing operations were properly continued by restriction through application Ser. No. 406,045 filed Oct. 12, 1973, and now U.S. Pat. No. 3,981,624, into the instant application, wherein original FIGS. 64–66 and 71–74 were reinserted as FIGS. 1–3 and 4–7, respectively, and the disclosures thereto and the balance of the originally filed claims were reinserted and the disclosure and claiming is now considerably expanded in the instant application over what was originally presented in my parent application Ser. No. 665,995 filed June 17, 1957, now U.S. Pat. No. 3,302,720.

In FIGS. 1–3 an uncased well bore is designated by the numeral 1150, the same being provided as is customary with a surface casing 1152. As will be understood, the well bore extends down into and through a permeable or productive strata of a formation. Shown at 1154 is a well casing or liner which it is desired to cement in the well bore 1150 in accordance with conventional usages and requirements.

In order to facilitate the application of the apparatuses and methods hereinbefore set forth in this application to the operation of cementing a well casing, liner or one or more lines of tubing in the well bore, an inlet conduit 1156 is connected with the casing, liner or tubing 1154 by an end portion 1158, a control valve 1160 being provided for the same. Similarly, a discharge portion 1162 is connected to the ground or surface casing 1152 by a portion 1164 and is likewise provided with a control valve 1166. The upper end of the casing, liner or tubing 1154 is provided with a suitable gate valve 1168 or other suitable means whereby access may be had to the entire cross sectional area of the casing, liner or tubing 1154 for a purpose to be subsequently apparent.

In accordance with this invention the inlet conduit 1156 under the control of its valve 1160 is adapted to be placed in communication with the various pumps or sonic or energy-carrying wave apparatus used for circulating the drilling mud, for introducing if desired fluids containing gases, foams, emulsions or solvents, for introduction of cementitious materials, and for introducing water or other fluid for applying pressure to the cementitious materials or where used upon the intermediary fluids and thus to the cementitious materials as hereinafter set forth, while the discharge conduit 1162 is adapted to place the well bore 1150 in communication with the circulating mud system, to discharge fluid from or into the well bore, and the like.

Since FIGS. 2 and 3 illustrate the sequence of the steps performed in both a conventional method of cementing and in a method of cementing in accordance with the present invention, each step of these methods will be described together in order to bring out more clearly the distinctions in the present method as compared to conventional practice and the advantages and novel results obtained thereby.

In order to cement a well it will be understood that the well bore 1150 is filled with the drilling mud, and the casing, liner or tubing 1154 inserted into the well bore is likewise filled with the drilling mud unless a float collar or shoe is placed on the bottom thereof in order to have the mud column assist in suspending the weight of the casing, liner or tubing and prevent the entry of the drilling mud thereinto, and this casing, liner or tubing is best lowered to the bottom of the well bore and then raised a sufficient distance to provide clearance desired between the bottom of the well bore and the casing, liner or tubing. In this position (shown by way of illustration in FIG. 1) both the well bore and the casing are filled with drilling mud.

As a preliminary step in the performance of a cementing operation under conventional practice, the casing, liner or tubing is at this time rotated and vertically reciprocated in order to effect by scraping or scratching the removal of as much as possible of the mud and filter cake on the wall of the well bore which would interfere with the establishment of a good engagement therewith by the cementing material. Further, for this purpose casing, liners or tubing usually have spring wires, wire brushes or other elements attached thereto at spaced intervals.

In the present method, however this preliminary step may be customarily completely omitted since as set forth hereinafter a more effective cleansing of the surface of the well bore is obtained without the above use of this conventional means thereby resulting in a very considerable saving of time and labor as well as providing greatly better bonding of cement to well bore and the casing, liner or tubing inserted therein.

By the use of sonic or energy-carrying waves of variable and modulated characteristics as given in much detail in my U.S. Pat. No. 3,640,344 which has been incorporated into this application by reference as to FIGS. 1–14 and portions of the specification as to Column 2, lines 6–11, lines 19–24; Column 4, lines 22–24; Column 6, line 41 to line 6, Column 7 and lines 40–60 thereof; Column 8, lines 55–72; Column 10, line 11 through all of Column 11 to line 8, Column 12 and lines 27–42, lines 52–68 thereof; Column 13, lines 8–45 and lines 53–58; Column 14, lines 11–73; Column 15, line 20 through all of Column 16 on to line 49, Column 17; and Column 18, line 18 to line 54, Column 19; a much greater efficiency of cleansing of the formation face of mud and filter cake and other debris may ensue and a much more uniform bonding of the cement may be had between the casing, liner or tubing and the walls of the well bore.

In many of the wells drilled into deeper formation or strata wherein high pressure oil and gas, and particularly so as to gas bearing strata, is encountered, in attempting to cement the annulus between the well bore and the fluid conductor, both the drilling mud and the forced into place cement slurry become gas cut to an extent that severe channeling results between the produced fluids and other permeable formations or strata which may be water bearing, barren of any fluids or surface low pressure strata to where continued loss of desired production is had as well as to pressure up the surface sands to an extent to become dangerous to drill through in other wells or have numerous leaks at old wells or breakouts at the surface.

By both field and laboratory experience I have found that these gas bubbles trapped in the cement slurry may be driven forward in a plug or ring like manner until a change of density of medium is encountered, as at the interface between the cement and the drilling mud being forced upward in the annulus, and there becomes a reception and reflective medium where the energy waves are vastly intensified into a considerable surging and oscillating force to remove mud or filter cake from the face of the formation.

After the above mentioned preliminary step, the first step in the conventional method of cementing usually consists in the introduction into casing, liner or tubing 1154 through valve or closure means 1168 of a first plug 1170, which is shown by way of illustration as being a solid plug, (but is usually of the bypassing type (not shown) which will trip upon striking a float or circulating collar affixed to the bottom of the casing, liner or tubing or affixed at various locations thereof where stage cementing is applied), and this plug is forced into position against top of the mud column (as shown in FIG. 64) or to the bottom of casing, liner or tubing 1154 where the casing, liner or tubing is run in dry by use of a float collor or shoe by the initial charge of cement or by the use of intermediary fluids as later explained in detail.

In the method of this invention, where the cementitious charge is applied above the plug 1170 this is accomplished by the use of sonic or energy-carrying waves of variable characteristics being applied upon the cementitious material. These sonic or energy-carrying waves being imparted thereto by the preferred form of apparatus, illustrated in FIG. 1 of my U.S. Pat. No. 3,640,344 which has been incorporated into this application by reference and described in certain portions of that specification as hereinbefore set forth, apply an injecting force against the cementitious charge upon the compressive or pressure portions of these waves and a withdrawal therefrom during the rarefied portions thereof and these momentary forces of injection and withdrawal may be greatly intensified and altered as explained in detail in my above patent in Column 15, line 66 to line 49, Column 17, wherein it is taught that modulations of withdrawal of energy and fluid from a wave cycle or group of wave cycles during the rarefaction portion of the wave cycle may be so modulated as to apply a much intensified withdrawal during what is termed a lagging effect applied by the modulation by proper phase angle application of the modulation and whereas an intense pushing effect may be applied by a wave cycle or group of waves cycles by varying the phase of the withdrawal of energy and fluid to what is termed a leading effect of the applied modulation, and wherein these modulations applied to the rarefied portions of wave cycles causes an impactual increase of amplitude to the compressive or pressure portions of the same wave cycles at least proportional to or greater than the intensity of the prior rarefactional or cavitational modulations applied thereto.

In the use of my improved method of cementing wherein the cement charge is used to force plug 1170 downward and force the drilling mud out of the casing, liner or tubing 1154 (as is sometimes done in conventional cementing) as shown by FIGS. 1 and 2, or when sufficient cement has been introduced into the casing, liner or tubing 1154 as preferred to complete the cementing of the same in the well bore, then there is usually inserted through means 1168 a second plug 1172 which is shut-off or solid plug, (although wherein stage cementing is being done this second plug would be a continuous cementing trip plug that would allow cement flowout between the well bore and the casing or liner above where a stage cementing collar had been located therein) and introduction pressure being and continuing against this plug 1172 is usually done through a pressure fluid such as water or the like applied through inlet conduit 1156.

When this plug 1172 is being forced downward in the casing, liner or tubing 1154 and displaces drilling mud between the well bore 1150 and the conductor 1154 there is a change of density and fluidity between the charge of cementitious material and the drilling mud of sufficient amount wherein sonic or energy-carrying waves as being applied to the cement charge as detailed above to where there is an increase of oscillation of the interface between the drilling mud and the cement being introduced and these forces of compression or pressure and rarefactions being applied to the face of the formation 1150 and the exterior of the conductor 1154 will be extremely beneficial and effective in the removing of materials adhering thereto such as mud or filter cake and the cleansing of interstitial spaces and pores of the formation face as the drilling mud is being forced out of the well bore through discharge conduit 1162. A great increase of effectiveness may be had by the use of a lagging type of modulation being applied to this interface of drilling mud and cement charge as may be found described above and in more detail in my above recited patent, in Column 18, lines 19–76.

A further increase in effectiveness of the removal of this mud or filter cake and the like while the drilling mud is being discharged through conduit 1162, is in the use of sonic or energy-carrying waves back down into the well bore 1150 while this drilling mud is being discharged outward through discharge conduit 1162. This application of sonic or energy-carrying waves may be applied by the use of the preferred form of apparatus which is FIG. 1 of my U.S. Pat. No. 3,640,344 incorporated into this application by reference, wherein piston type oscillator 1080 may be utilized for this purpose and discharge valve 1076 may be the valve used for discharging the drilling mud through. This valve may be varied as to the discharge rate allowed therethrough or it may be the modulating means for the sonic or energy-carrying waves being sent down the well bore 1150 by the piston oscillator 1080 by the withdrawal of fluid and energy from the rarefaction portion of the wave cycles being sent down the well bore. This discharge of the drilling mud through valve 1076 when it is being used as a modulating means, will be especially beneficial and effective if the withdrawal of the fluid and energy is applied in a lagging fashion from one wave cycle or group of wave cycles out of several being applied, as is explained hereinbefore in considerable detail. This lagging effect may be intensified to where a surface fracturing or rupturing effect will be produced on the interstices and pores of the formation exposed to the well bore 1150 and matter clinging to the exterior surface of the casing, liner or tubing 1154 such as rust and formation debris through which this conductor has been inserted will be substantially completely cleansed therefrom and discharged outward with the drilling mud, and thus an extremely uniform and effective bonding of the cement to the formation and to the conductor 1154 may be achieved as the cementitious material is being forced upward from the bottom of the well bore. An increased effectiveness in the use of sonic or energy-carrying waves is achieved wherein these waves are being applied at a phase angle to other sonic or energy-carrying waves being applied to the cement that is being introduced as is shown in the disclosure relating to FIG. 1 of the cited patent as to the use of piston oscillator 1086 and modulating valve 1092 upon the cementitous material being introduced in conjunction with the use of piston oscillator 1080 and modulating valve 1076 upon the drilling mud being discharged.

In conventional cementing wherein conductors 1154 of FIGS. 1–3 of this application are being cemented into well bores, as the plug 1172 applies an injection force to the cement as it is being forced out of this conductor 1154 and upward in the displacing of the drilling mud outward through discharge conduit 1162, to a varied extent, it is customary to sometimes impart a further rotation and reciprocation to the conductor 1154 in order to facilitate the dislodgment of any mud or filter cake or other debris that may have been left between the well bore and the casing, liner or tubing 1154.

In the use of sonic or energy-carrying waves as taught in this application, this last step above described may be eliminated since the pulsating pressures and rarefactions imparted at the interface between the cementitious material and the drilling mud as hereinbefore described in detail will cause the dislodgment of any mud or filter cake left on the formation face or the exterior of the conductor 1154 and keep the same substantially suspended in the drilling mud as it is being driven upward and discharged at conduit 1162 in a substantially uniform plug like manner that is unable to be obtained by any of the conventional methods such as turbulent or attempted plug like flow, until shut-off or solid plug 1172 reaches the bottom of casing, liner or tubing 1154 and lodges against the float shoe or collar, if one is used, or if stage cementing is being done this bottom plug will be of the bypassing type and after it lands cement will be continued to be pumped therethrough until the continuous cementing trip plug lands in the stage cementing collar and an inserted shutoff plug continues to introduce cement into the second or more stages of the location of the stage cementing collar. Whether the cementing is of the single stage as shown by way of illustration in FIG. 3 or is in two or more stages the effectiveness of the methods of this invention in removal of the mud and filter cake from the face of the formation and allowing discharge of this through discharge outlet 1162 will far surpass any of the conventional methods now in use.

However, it should be noted that in accordance with this invention sonic or energy-carrying waves of variable characteristics applied to cementitious material greatly facilitates the flow of the material into interstices it would be unable to penetrate by only the applying of pressure and causes the same to flow as if it were more fluid, so that a much drier cement slurry may be mixed and introduced than is possible under conventional practice, and by field testing under varying conditions it has been found by the applicant that pressures of less than half that employed in conventional practices is required to pump such slurries and mixtures of solids and fluids as is used in drilling mud, and yet far more desirous results of adhesion of the cement to other structures such as formations and conductors of fluids placed therein are obtained.

Moreover, in the use of this invention there is a further step that may be used advantageously to most effectively create a bond between the formation within the well bore 1150 and the casing, liner or tubing 1154, which is in the use of various types of gases, foams, emulsions or solvents (which could include water in the hotter formations found at greater depths) to effect a more efficient cleansing of the face of the formation in the well bore 1150 and to assist in the dislodgment of mud or filter cake and formation debris or the like from the interstices or pores of the face of this formation or strata through which the well bore 1150 is drilled, wherein surface fracturing or rupturing into these interstices and pores of the formation may be attained when it is necessary or desirable to obtain bonding thereinto of the cementitious material, as well as from the exterior of the casing, liner or tubing inserted in the well bore.

As explained in considerable detail in my U.S. Pat. No. 3,640,344 which has been incorporated into this application by reference as to FIGS. 1–14 and certain portions of the specification as hereinbefore recited in detail from the soft copy thereof which is enclosed herewith and particularly as so recited specifically therein in Column 6, lines 55–64, Column 8, lines 55–72, in the use of sonic or energy-carrying waves a change in density of a transmitting medium as from a liquid to a fluid containing gases or vapors, the gases or vapors act as a reception point or station for the sonic or energy-carrying waves and while reflection of certain portions of this received energy is done wherein a condition of resonance or of a standing wave continues to add energy thereto in intensifying these waves, yet a considerable portion of the energy of these waves accumulates at the interface of the liquid and the gases or vapors and greatly amplifies the sonic or energy-carrying waves into doing useful work and oscillation thereat. By the applying of modulations to certain of these waves, as in the withdrawal of energy and fluid therefrom during the rarefactions thereof, intense pulling or lagging and pushing or leading effects may be accomplished by these so modulated waves as may be found explained in detail in above recited patent in Column 15, line 66 to line 49, Column 17 and in Column 18, lines 19–76 and the total effectiveness of these sonic or energy-carrying waves greatly multiplied in effecting total cleansing of the interstices and pores of the face of the formation and if desired rupturing or fracturing of the surface face of the formation or strata may be achieved or fracturing of the whole of the formation may be accomplished if desired.

Thus, another step would be introducing fluids composed of or containing gases, foams, emulsions or solvents that would have a vapor pressure such that these fluids would become vaporous or gaseous during at least rarefied portions of some of these sonic or energy-carrying waves being applied thereto into the conductor 1154 of FIG. 1 of this application as by inlet means 1158 and these fluids could be followed by use of another plug such as herein shown in FIGS. 2 and 3 and designated as plug 1172 and this plug would be forced downward by the charge of cement being introduced and would either force plug 1170 out of the bottom of conductor 1154 or if of a by-passing type would land in the float collar or shoe and thereafter allow this fluid to displace the drilling mud upward between the well bore and conductor 1154, or this gaseous or vaporous fluid could be inserted in the leading edge of the introduced charge of cement so as to effect an even greater change of density between the drilling mud and the cement and a much greater amplification effect on its reception of the sonic or energy-carrying waves.

Normally, where a very light fluid as above described is forced by pressure against a fluid of the density of drilling mud wherein large amounts of pulverized solids such as barite are used for its weighting effect against well blow-outs from high pressured subterranean fluids, the lighter fluid would quickly finger upward in one or more locations through this very heavy mud. However, applicant has found by extensive testing that when using sonic or energy-carrying waves of the intensity and force as has been discussed above upon a slug of fluid composed of or containing gaseous or vaporous contents, that the alternating compressive or pressure portions of these wave cycles use the fluid as a propelling agent to substantially create a plug like discharge of the drilling mud up the well bore and out through the discharge conduit 1162.

A further very important use of fluids containing or composed of gases, foams, emulsions or solvents (including water) in cementing of casing, liners or tubing inserted into well bores into formations, is in the pumping of these fluids into the annulus between the formation and the conductor 1154 as shown is FIGS. 1–3, as through the discharge conduit 1162, prior to or during the discharging of the drilling mud therefrom. This may be accomplished by use of one of the sonic wave generators depicted in FIG. 1 of the above cited patent which is incorporated into this application by reference, as shown therein by numerals 1080 and 1076. The introduction of these fluids may be through a valve in the head of piston 1080 (not shown) as explained in Column 16, lines 12–34, which same manner of introduction may also be used for the introduction of cementitious material or pressure fluids into conductor 1154 as hereinbefore discussed and may be so introduced into the drilling mud prior to or during the discharging of drilling mud through valve 1076.

Where the piston type oscillator 1080 and the modulator valve 1076 are used as the point of introduction of the fluid and discharge of drilling mud, respectively, as explained above, there is an augmentation of output of the wave energy as created by piston oscillator 1080 and wave modulator valve 1076 which further assists in the dislodgement of the mud and filter cake from the walls of the formation. While it would be advantageous to force the vaporous or gaseous fluid to the bottom of the annulus between the formation and the conductor through the drilling mud in order have an effective means to scrub the formation face and the exterior of the conductor 1154 as well as to lighten the weight of the drilling mud and thus produce better bonding of the cement to the face of the formation and the conductor, yet in many instances such lightening of the drilling mud would allow blowouts from high pressured subsurface fluids from strata through which the well bore had been drilled, so in formations having such high pressured fluids safe operations would be to only introduce enough fluid through conduit 1162 prior to or during the discharging of the drilling mud therefrom that would be sufficient to extend to a distance down the annulus that would not approach any strata having such high pressured fluids. In these instances cited above the introduction of vaporous or gaseous fluids that would have an effect of localizing the sonic or energy waves in the lower portion of the annulus for oscillating scrubing action would be such fluids as had been introduced into the leading edge of the charge of cement that was driving the drilling mud upward in this annulus and the sonic or energy-carrying waves having an effect on this gaseous or vaporous leading edge would be those energy waves being transmitted through the charge of cement.

In the utilization of these energy waves as so recited above wherein energy waves were being imposed on both the cementitious material and the discharging drilling mud, a more effective use of these waves would be in maintaining a phase angle relationship between the energy waves being imposed on the drilling mud and the charge of cement or in the phase angle relationship existing between modulations impressed on these sonic or energy-carrying waves so that an augmentation of the rarefactions or compressions of these energy waves may be achieved and a pushing and pulling effect may be imposed on the annulus and the drilling mud therein as for instance in the imposing of a leading modulation being impressed on the charge of cement and thus be transmitted to its interface with the drilling mud and the fluids that may be introduced thereat as hereinbefore explained and the imposing of a lagging type modulation of the energy wave being transmitted down the annulus through the drilling mud to this interface as may be found explained in detail in my cited U.S. Pat. No. 3,640,344 incorporated into this application by reference as being applied to energy wave fracturing of formations, in Column 18, lines 46–75.

SQUEEZE CEMENTING IN SUBSURFACE FORMATION

Reference is made next to FIGS. 4–7. In these FIGURES is shown a manner in which the principles of applying sonic or energy-carrying waves to various conventional or typical operations of squeeze cementing may be beneficially employed in various specific squeeze cementing situations and techniques.

Figures 4, 5, 6, 7:
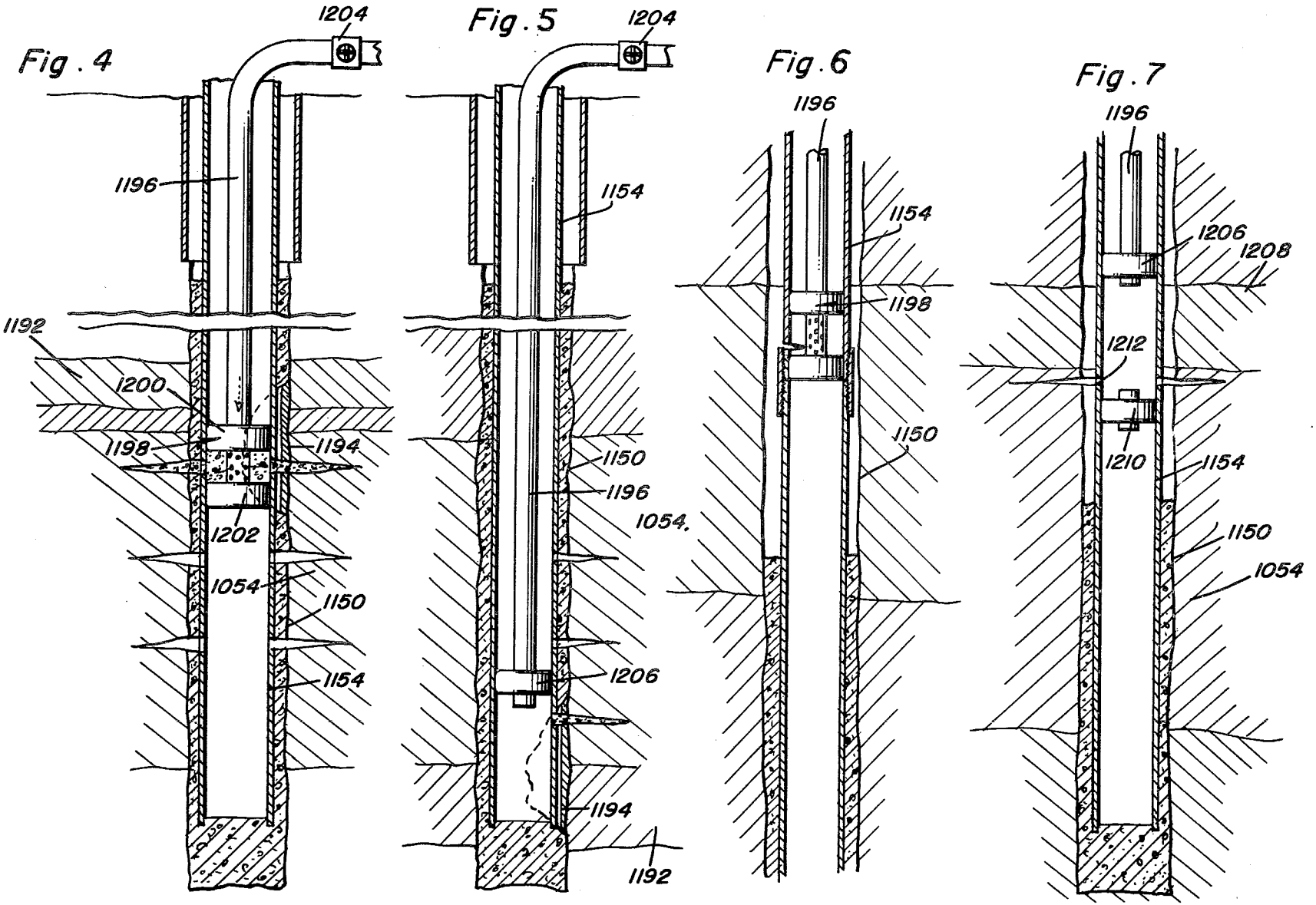
FIGS. 4–7 are diagrammatic views, with parts broken away, illustrating in vertical section various conventional squeeze cementing practices as applied to cased or lined wells and to which the principles of this invention are applied.

Reference is made to FIG. 4 wherein the casing or liner is shown cemented to a well bore 1150. In this example the productive oil and gas sand or strata 1054 lies below a gas or water bearing strata 1192 and a portion or area of a mud or filter cake 1194 upon the well bore has not been removed by the cementing operation, this mud or filter cake extenting from the region of the strata 1192 down the well bore into the productive strata 1054 so that the production of oil and gas from the productive strata 1054 is being contaminated by the inflow of fluid from strata 1192 passing through the area occupied by the mud or filter cake 1194 in which there is not seal established by the cementitious material. In order to correct such a condition, which is one of relatively frequent occurrence, the conventional method disclosed in FIG. 1 is usually employed to squeeze cement through the upper producing perforations or others created thereinto the casing or liner to thereby complete an effective cement seal or bond between the two strata.

For this purpose tubing 1196, having at its lower end a conventional straddle packer 1198, is introduced into the casing or liner in order that the two packer elements 1200 and 1202 may straddle that portion of the the perforated well casing or liner into which the contaminating fluids are flowing. In the conventional squeeze cementing operation usually employed, cement is supplied under great pressure from any suitable source under the control of a valve 1204 through the tubing 1196, on through holes or perforations in the tubing or hollow member between the upper and lower packer elements, and thence through the peforated casing or liner into the area of the non-displaced mud or filter cake, and is then pressed into intimate contact with the previously applied cement lining, casing and the formation to thereby seal off the same and block the ingress of fluid from the strata 1192. Obviously, vary great pressures are required for this purpose in order to insure the establishment of an adequate sealing engagement of the cement patch which is applied. However, in the use of this operation there are numerous failures encountered due to the mud or filter cake becoming intermixed with the introduced cement slurry or the compacting of this mud or filter cake further into the interstices of the face of the formation or strata.

In accordance with the present method the introduction of the cement under pressure is accomplished by the application of sonic or energy-carrying waves and additional fluids applied thereto as set forth hereinbefore in connection with cementing operations relating to well bores in formations and fluid conductors inserted thereinto, and particularly with reference to FIGS. 1–3 of this application, and these sonic or energy-carrying waves and modulations thereto render the cement relatively more fluid or flowable, and facilitate the movement of the cement through the casing or liner perforations and into the region of the mud or filter cake to effect a complete sealing and impregnation of the region of leakage of fluids. In many instances where extremely high pressures of subsurface fluids are encountered a better bonding of the cement to the interstices of the face of the strata is needed and to achieve this purpose modulations of the energy waves are used in such a manner that a lagging or pulling type of wave is impressed on the cement slurry to effect a complete cleansing of the interstices of the strata to the extent that surface fracturing or rupturing of the face of the strata is produced and thereafter a leading or pushing type of modulation is utilized to impregnate these cleansed interstices of the strata with the introduced cement slurry. As hereinbefore discussed as to means of introduction of cementitious material into subsurface formations, the compressive or pressure portion of the sonic or energy-carrying waves used herein produce a pressure injection of the cement slurry, while the rarefaction portions of these waves accomplish a momentary withdrawal or lowering of injection pressure upon this injection of slurry, thus producing surging and oscillations of pressure and rarefactions at the interface or contact point of this cement slurry with fluids or material of different densities thereto. The addition of modulations impress greatly intensified increases of rarefactions and compressions to these energy waves, and by varying the phase angle of these modulations intense pulling or lagging effects may be produced and by leading these modulations in relation to the energy waves intense and severe pushing effects may be produced and transmitted to an area upon which these types of energy waves are being impressed and whereat there is a change of density to that of the transmitting medium.

Thus where slurry alone under pressure is introduced into these areas of by-passed mud or filter cake, a lagging type of modulation is imposed on the slurry to cleanse the formation face and this is followed by a leading type of modulation to impress and impregnate the interstices of the face of the formation and effect a complete and lasting bonding of the slurry to the other cementing formerly performed in the annulus above and below this area that was imperfectly cemented. As previously set forth in this application, where sonic or energy-carrying waves are being utilized as discussed herein, pressures needed for squeeze cemnting are lowered to considerably less than half that normally used in conventional methods, and yet results are obtainable that may not be produced by pressures greatly exceeding those used in conventional methods.

A considerably better and more effective cleansing of these areas of by-passed mud or filter cake behind fluid conductors in well bores may be achieved by the use of fluids containing or composed of gases, foam, emulsions or solvents either in the leading edge of the cement slurry, or as being introduced prior to or ahead of the cement slurry.

In the same manner as previously explained in the section of this application in regard to cementing of fluid conductors in well bores, in instances where it is necessary or desired, the interstices of the formation or strata may be surface fractured or ruptured so as to overcome any foreign substances that are adhering to the formation face as well as the cement already in place in the annulus above and below the point where this squeeze cementing is being consumated and for this purpose fluids containing or composed of gaseous or vaporous fluids may be used as the cleansing agent.

Where there are long intervals of mud or filter cake or gas cut cement that should be withdrawn entirely from the the portion of the annulus wherein channeling of fluids have been occurring one or more perforations are caused through the casing or liner 1154 above the point that upper packer 1200 is set, FIG. 4, into strata 1192 containing the undesired fluid that has been channeling down to the production perforations, and the squeeze job may be performed with cement slurry being forced either down fluid conductor 1154 or down tubing 1196 and by the use of energy waves as previously described in detail may be used on the cement slurry being introduced. In this connection it is particularly meritorious to use the two wave generators of FIG. 1 of the cited patent and by varying the phase angle thereof or of modulated waves produced thereby the mud and filter cake or gas cut cement may be withdrawn by a lag or pulling type of modulation and the injection of this slurry being squeezed is better done with the lead or pushing type of modulation as described in much detail in my cited patent which is incorporated into this application by reference.

The last above operation would be of extreme benefit in insuring a non leaking patch between the previously cemented portions of the annulus above and below that portion being squeeze cemented and cleansing out even the smallest interstices of the portions of the annulus wherein the cement patch was being applied, if the previously described use of fluids containing or composed of gases, foam, emulsions or solvents were used in conjunction with last above operation of use of energy waves and modulations applied thereto, and the use of these fluids are in the manner earlier described hereinbefore with the use of two energy wave generators.

In FIG. 5 is shown a variation of the above described method relating to conditions as existed as to FIG. 4 but one in which the contaminating water or fluids are entering the casing or liner 1154 at or adjacent the lower end thereof as by the existence of a mud or filter cake 1194 at that region. The contaminating strata in this illustration is again designated by the numeral 1192 but is now shown positioned below or adjacent the bottom of productive strata 1054.

In this situation the usual method is to lower a single packer member 1206 towards the bottom of the well bore by means of tubing 1196, to a position slightly above the point of entry of the contaminating fluid into the casing or liner or where a perforation thereinto would allow the squeezed cement to either eliminate the packed to mud or filter cake or squeeze the cement back into the bottom water to halt its intrusion into production.

In accordance with this invention and the use of the methods described as to FIG. 4 the high injection pressures ordinarily used for these bottom types of squeezing operations are no longer necessary, for as hereinbefore explained the type of energy waves used to produce excellent results require considerably less than half the pressure customarily used. Also in eliminating bottom water that is coning to the well bore and gradually or completely taking over desired production of oil or gas, the formation may be fractured at a position adjacent the interface of the oil or gas and bottom water by the use of energy waves and modulations thereto and the cement squeezed out into the formation or strata in a pancake like fashion to the desired amount and thus permently seal off the intrusion of this water into the productive strata 1054. Applicant has found in many fracturing jobs performed on productive strata where there was a water sand in open communication with the well bore along with productive strata, that if pressures on the well bore are kept below that normally needed to conventionally fracture formations, that energy wave fracturing of the productive strata containing oil or gas may be successfully consumated with absolutely no fracturing of the formation containing water, whether fresh or saline, or whatever location the water sand may occur in relation to the productive sand or strata. Thus, if desired, fracturing to a considerable distance may be performed at the interface of oil or gas and water bearing strata and cement injected thereinto to make a permanent installation for production for the future.

FIG. 6 illustrates a situation wherein there has been a rupture or split in the casing or liner 1154 which lies above the previously performed conventional cementing operation, and whereby fluid is being lost from or enters into casing or liner 1154. In order to rectify this condition the straddle packer 1198 is lowered into the casing or liner 1154 on tubing 1196 until the rupture or split is enclosed within the two packers. A charge of cement slurry under high pressure is then introduced down the tubing and injected between the packers and from thence through the rupture or split into the annulus between casing or liner until a seal is effected. In usual practice the rupture or split has occurred at a zone of weakness or ineffectual primary cementing of the casing or liner into the well bore, or may be above the extent that the casing or liner was cemented into the well bore initially. In case the last condition exists the squeezing of the cement continues in many instances until the slurry begins discharging at the surface, where a back pressure is often maintained to allow for a more complete bonding of the cement throughout the annulus, while at the same time effecting a bonding connection to the existing lower primary cementing job. Since many of these types of casing or liner failures are in wells that have been producing for many years, considerable rusting and other types of formation debris often prevents any hope of lasting sealing of the rupture or split is prevented.

In the use of the methods described in this application as explained fully earlier herein the effects of sonic or energy-carrying waves and modulations thereof and the added inclusion of various types of fluids as cleansing and reception means for localizing the oscillations and surging effects, and even in many instances the need to fracture or rupture to a relatively shallow depth, results are obtained that effect substantially perfect sealing of the rupture or split and give long lasting results. Since the methods to be performed are but duplications of those described as to FIG. 4 it is deemed unnecessary to reiterate them as to those that are used with FIG. 6.

FIG. 7 discloses a relatively frequently occurring situation in which production has been abandoned from a lower portion of a productive strata, either because of water production increasing or coning from a water section of the strata or other cause, or from another oil or gas productive strata that is either above or below the portion of strata from which producis now desired. As shown diagrammatically in FIG. 7, a casing or liner 1154 has been sealed in good bonding condition to the face of the formation or strata 1150, however, as shown, the cement seal in the annulus has not extended past the portion of the productive strata from which the previous production was obtained. Since perforating through the casing or liner into the new section of strata from which production is desired, would merely open the production up to the annulus as well as to the production string, the annulus must be sealed between the formation face and the fluid conductor 1154. For this purpose one or more perforations 1212 are performed, and cement slurry under high pressure is introduced down tubing 1196 and forced out into the annulus between the formation face 1150 and fluid conductor 1154 until the desired or needed seal is effected. After this and when time has elapsed for the cement to set, the casing or liner is again perforated for access to that portion of productive strata from which production is now wanted.

In the use of the various methods as has hereinbefore described in detail as to FIG. 4 an assurity of effectual sealing of this new section of annulus is squeeze cemented at pressures considerably less than half that encountered in conventional practice, which is of significance in older wells wherein years of production has greatly weakened the walls of the casing or liner, and by using the proper type of modulations and the additions of certain types of cleansing fluids of sufficient vapor pressure the operator is assured of secure and lasting bonding of the cement to both formation face and fluid conductor 1154.

What I claim is:

1. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing a fluid composed of or containing a gas, foam, emulsion or solvent into said casing, liner or tubing prior to the introduction of cement under pressure of said compression portion of said sonic or energy-carrying wave, wherein said fluid becomes gaseous or vaporous during at least a rarefied portion of said sonic or energy-carrying wave.

2. The method of claim 1 wherein said rarefied portion of said sonic or energy-carrying wave is a modulated portion of said sonic or energy-carrying wave.

3. The method of claim 2 including intensifying said modulation of said sonic or energy-carrying wave to an extent that the face of formation surrounding said well bore is ruptured or fractured to a relatively shallow extent to effect an increased efficiency of bonding of said cement to said formation and utilizing said gaseous or vaporous fluid to scavenge the face of said formation and displace the resulting formation debris from said well bore in conjunction with the drilling mud.

4. The method of claim 3 including varying the phase angle of said modulation of said sonic or energy-carrying wave.

5. The method of claim 2 wherein said modulated portion of said sonic or energy-carrying wave being applied to said charge of cement is maintained in phase angle relationship with a modulation being imposed on a portion of a sonic or energy-carrying wave being applied to the drilling mud or other debris being displaced by said charge of cement.

6. The method of claim 5 including varying the phase angle relationship of said modulated sonic or energy-carrying wave being applied to said charge of cement as to said modulated sonic or energy-carrying wave being applied to said drilling mud or other debris.

7. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, wherein said sonic or energy-carrying wave is modulated during the rarefied portion thereof and achieves a greater rarefaction effect and increased intensity of the whole of said sonic or energy-carrying wave.

8. The method of claim 7 including varying the phase angle of said modulation of said sonic or energy-carrying wave.

9. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including applying a sonic or energy-carrying wave to said drilling mud or other debris being displaced from said well bore by said charge of cement under pressure of said compression portion of said sonic or energy-carrying wave, wherein said drilling mud or other debris is displaced from said well bore during a rarefied portion of said sonic or energy-carrying wave.

10. The method of claim 9 wherein said rarefied portion of said sonic or energy-carrying wave is a modulated portion of said sonic or energy-carrying wave.

11. The method of claim 10 including varying the phase angle of said modulation of said sonic or energy-carrying wave.

12. The method of claim 10 including introducing a fluid composed of or containing a gas, foam, emulsion or solvent into said well bore prior to or during the displacing of said drilling mud from said well bore.

13. The method of claim 12 wherein said fluid becomes gaseous or vaporous during at least the modulated rarefied portion of said sonic or energy-carrying wave.

14. The method of claim 13 including intensifying said modulation of said sonic or energy-carrying wave to an extent that the face of formation surrounding said well bore is ruptured or fractured to a relatively shallow extent to effect an increased efficiency of bonding of said cement to said formation and utilizing said gaseous or vaporous fluid to scavenge the face of said formation and of said casing, liner or tubing and displace the resulting formation and other debris from said well bore in conjunction with the drilling mud.

15. The method of claim 14 including varing the phase angle of said modulation of said sonic or energy-carrying wave.

16. The method of claim 9 including displacing said drilling mud or said other debris from said well bore during a rarefied portion of a second of said sonic or energy-carrying waves, varying the displacing of or the phase angle of said second of said sonic or energy-carrying waves as to the first of said sonic or energy-carrying waves.

17. The method of claim 16 wherein the second of said rarefied portions of said sonic or energy-carrying waves is a modulated portion of said sonic or energy-carrying wave.

18. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, wherein said charge of cement is utilized for squeeze cementing of channels or pockets of drilling mud or other debris existing below or between casing, liner or tubing and the formation in said well bore, or of holes or ruptures existing in said casing, liner or tubing that contact or communicate with said formation or undesired fluids coming therefrom or entering into said formation, including introducing a fluid composed of or containing a gas, foam, emulsion or solvent into said casing, liner or tubing prior to the introduction of said charge of cement utilized for said squeeze cementing, wherein said fluid becomes gaseous or vaporous during at least a rarefied portion of said sonic or energy-carrying wave.

19. The method of claim 18 wherein said rarefied portion is a modulated portion of said sonic or energy-carrying wave.

20. The method of claim 19 including varying the phase angle of said modulation of said rarefied portion of said sonic or energy-carrying wave.

21. The method of claim 19 including applying a sonic or energy-carrying wave to said drilling mud or other debris being displaced from said well bore, casing, liner or tubing by said charge of cement.

22. The method of claim 21 wherein said sonic or energy-carrying wave is modulated during the rarefied portion thereof.

23. The method of claim 22 including varying the phase angle of said modulation of said sonic or energy-carrying wave.

24. The method of claim 22 wherein said sonic or energy-carrying wave being applied to said charge of cement is modulated during a rarefied portion thereof and said modulated sonic or energy-carrying wave being applied to said drilling mud or other debris is maintained in phase angle relationship with said modulated sonic or energy-carrying wave being applied to said charge of cement.

25. The method of claim 24 including varying the phase angle relationship of said modulated sonic or energy-carrying wave being applied to said drilling mud or other debris as to said modulated sonic or energy-carrying wave being applied to said charge of cement.

26. The method of claim 19 including intensifying said modulation of said sonic or energy-carrying wave in said charge of cement or said drilling mud to an extent that the face of formation surrounding or below said well bore is ruptured or fractured to a relatively shallow extent to effect an increased effeciency of bonding of said cement to said formation, casing, liner or tubing and displace the resulting debris from said well bore, formation, casing, liner or tubing in conjunction with said drilling mud or other debris therefrom.

27. The method of claim 26 including varying the phase angle of said modulation of said sonic or energy-carrying wave.

28. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including applying a sonic or energy-carrying wave to said drilling mud or other debris being displaced from said well bore by said charge of cement under pressure of said compression portion of said sonic or energy-carrying wave, including maintaining a phase angle relationship between the sonic or energy-carrying wave being applied to said charge of cement and said sonic or energy-carrying wave being applied to said drilling mud or other debris being displaced by said charge of cement.

29. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, wherein said compression portion of said sonic or energy-carrying wave is a modulated portion of said sonic or energy-carrying wave.

30. The method of claim 29 including varying the phase angle of said modulation of said sonic or energy-carrying wave.

31. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing a pressure fluid into said casing, liner or tubing following said charge of cement for forcing the latter into place below or between said casing, liner or tubing and the walls of said well bore by said compression portion of said sonic or energy-carrying wave, wherein said compression portion of said sonic or energy-carrying wave is a modulated portion of said sonic or energy-carrying wave.

32. The method of claim 31 including varying the phase angle of said modulation of said sonic or energy-carrying wave.

33. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing a pressure fluid into said casing, liner or tubing following said charge of cement for forcing the latter into place below or between said casing, liner or tubing and the walls of said well bore by said compression portion of said sonic or energy-carrying wave, including introducing a fluid composed of or containing a gas, foam, emulsion or solvent into said casing, liner or tubing prior to the introduction of said cement under pressure of said compression portion of said sonic or energy-carrying wave.

34. The method of claim 33 wherein said compression portion of said sonic or energy-carrying wave is a modulated portion of said sonic or energy-carrying wave.

35. The method of claim 34 including varying the phase angle of said modulation of said sonic or energy-carrying wave.

36. The method of claim 33 wherein said fluid becomes gaseous or vaporous during at least a rarefied portion of said sonic or energy-carrying wave.

37. The method of claim 36 wherein said rarefied portion of said sonic or energy-carrying wave is a modulated portion of said sonic or energy-carrying wave.

38. The method of claim 37 including varying the phase angle of said modulation of said sonic or energy-carrying wave.

39. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing a pressure fluid into said casing, liner or tubing following said charge of cement for forcing the latter into place below or between said casing, liner or tubing and the walls of said well bore by said compression portion of said sonic or energy-carrying wave, including applying a sonic or energy-carrying wave to said drilling mud or other debris being displaced from said well bore by said charge of cement under pressure of said compression portion of said sonic or energy-carrying wave, wherein said compression portion of said sonic or energy-carrying wave is a modulated portion of said sonic or energy-carrying wave.

40. The method of claim 39 including varying the phase angle of said modulation of said sonic or energy-carrying wave.

41. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing a pressure fluid into said casing, liner or tubing following said charge of cement for forcing the latter into place below or between said casing, liner or tubing and the walls of said well bore by said compression portion of said sonic or energy-carrying wave, wherein said drilling mud or other debris is displaced from said well bore during a rarefied portion of said sonic or energy-carrying wave.

42. The method of claim 41 wherein said rarefied portion os said sonic or energy-carrying wave is a modulated portion of said sonic or energy-carrying wave.

43. The method of claim 42 including varying the phase angle of said modulation of said sonic or energy-carrying wave.

44. The method of claim 42 including introducing a fluid composed of or containing a gas, foam, emulsion or solvent into said well bore prior to the displacing of said drilling mud or other debris from said well bore during said modulated rarefied portion of said sonic or energy-carrying wave.

45. The method of claim 44 including varying the phase angle of said modulation of said sonic or energy-carrying wave.

46. The method of claim 44 including intensifying said modulation of said sonic or energy-carrying wave to an extent that the face of formation surrounding said well bore is ruptured or fractured to a relatively shallow extent to effect an increased efficiency of bonding of said cement to said formation and utilizing said gaseous or vaporous fluid to scavenge the face of said formation and displace the resulting formation debris from said well bore in conjunction with the drilling mud.

47. The method of claim 46 including varying the phase angle of said modulation of said sonic or energy-carrying wave.

48. The method of claim 44 wherein said fluid becomes gaseous or vaporous during at least said rarefied portion of said sonic or energy-carrying wave.

49. The method of claim 48 including varying the phase angle of said modulated rarefied portion of said sonic or energy-carrying wave.

50. A method of cementing casing, liner or tubing in a well bore comprising the steps of introducing into a well casing, liner or tubing a charge of cement under pressure of the compression portion of a sonic or energy-carrying wave, and displacing drilling mud or other debris in said well bore below or between said casing, liner or tubing and the walls of said well bore by said charge of cement, including introducing into said well bore and upon said charge of cement a second of said compression portions of a sonic or energy-carrying wave, varying the admittance of or the phase angle of said second of said sonic or energy-carrying waves as to the first of said sonic or energy-carrying waves.

51. The method of claim 50 wherein the second of said compression portions of said sonic or energy-carrying waves is a modulated portion of said sonic or energy-carrying wave.

* * * * *